US008568947B2

(12) United States Patent
Ohno et al.

(10) Patent No.: US 8,568,947 B2
(45) Date of Patent: Oct. 29, 2013

(54) GREEN TONER FOR DEVELOPING STATIC LATENT IMAGE AND FULL COLOR IMAGE FORMING METHOD

(75) Inventors: Yohei Ohno, Tokyo (JP); Hajime Tadokoro, Kanagawa (JP); Kaori Matsushima, Tokyo (JP); Hiroyuki Yasukawa, Tokyo (JP); Ito Koga, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/372,154

(22) Filed: Feb. 13, 2012

(65) Prior Publication Data

US 2012/0219892 A1 Aug. 30, 2012

(30) Foreign Application Priority Data

Feb. 25, 2011 (JP) ..... 2011-039640

(51) Int. Cl.
*G03G 9/08* (2006.01)

(52) U.S. Cl.
USPC ..... 430/107.1; 430/108.15; 430/108.21

(58) Field of Classification Search
USPC ..... 430/107.1, 108.15, 108.21
See application file for complete search history.

(56) References Cited

U.S. PATENT DOCUMENTS 7,527,809 B2 * 5/2009 Yano et al. ..... 424/489

FOREIGN PATENT DOCUMENTS

JP 2004-070089 3/2004

* cited by examiner

*Primary Examiner* — Mark A Chapman
(74) *Attorney, Agent, or Firm* — Lucas & Mercanti, LLP

(57) ABSTRACT

Disclosed is a green toner for developing a static latent image containing a binder resin and a colorant, and the colorant contains C.I. Solvent Green 5 and colorant compound X represented by Formula (1), and content ratio of C.I. Solvent Green 5 in whole amount of the colorant is 5 to 50% by weight, Formula (1)

in the Formula (1), $M^1$ is a metal atom of Group 14, Q is independently a monovalent substituent, m and n are each 0 or 1, at least one of m and n is 1, and A is independently an atomic group forming an aromatic ring which may have a substituent.

11 Claims, 1 Drawing Sheet

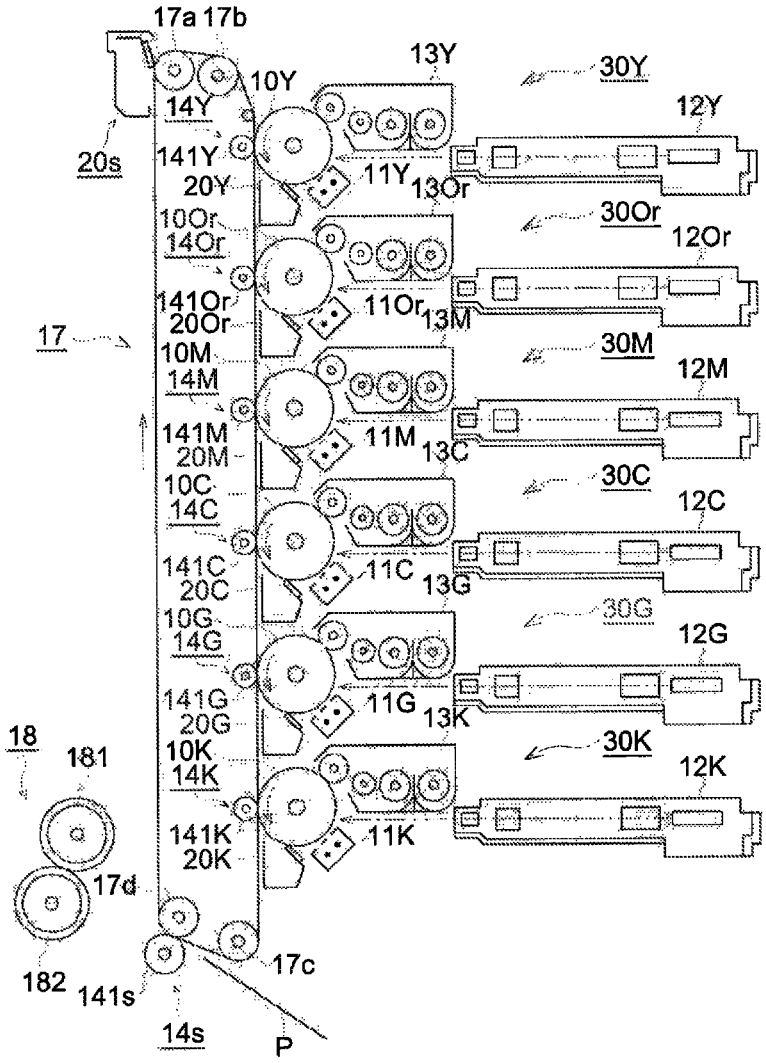
17a 17b
13Y
30Y
10Y
14Y
12Y
20s
141Y
20Y
11Y
13Or
30Or
10Or
14Or
12Or
141Or
20Or
11Or
13M
17
30M
10M
14M
12M
141M
20M
11M
13C
30C
10C
14C
12C
141C
20C
11C
13G
30G
10G
14G
12G
141G
20G
11G
13K
18
181
30K
10K
14K
12K
141K
20K
11K
17d
182
141s
17c
14s
P

GREEN TONER FOR DEVELOPING STATIC LATENT IMAGE AND FULL COLOR IMAGE FORMING METHOD

This application is based on Japanese Patent Application No. JP2011-039640 filed on Feb. 25, 2011, in Japanese Patent Office, the entire content of which is hereby incorporated by reference.

FIELD OF THE INVENTION

The present invention relates to a green toner for developing a static latent image and a full color image forming method, more in detail a green toner for developing a static latent image used for an electrophotographic image forming apparatus and a full color image forming method.

BACKGROUND

Recently, opportunity to form a full color image is increasing in addition to conventional monochrome image using a toner for developing a static latent image ("toner") in an image forming method via an electrophotography. The full color image forming method via an electrophotography is broadly used in a convenient printing field since necessary numbers of printed material can be manufactured on demand because of no printing plated is not necessary.

IT revolution commenced in 1990's introduces the circumstances of printing field to digital process markedly, RGB original has been normalized, and the data has been shifted to broader color reproduction area.

However, since full color image forming method by an electrophotography displays colors via subtractive color process by refractive light, color reproduction range is too small in comparison with display having a light source by itself via an additive color process, and therefore there is such a problem that it is difficult to reproduce a full color image shown on the display on a transfer material such as paper.

Particularly, there is a problem that color reproduction property of in high brightness region of secondary color prepared by overlapping two kinds of toners is poor. Practically, a toner image by yellow toner and a toner image cyan toner are superposed to reproduce green color, for example, chroma and brightness are reduced, and therefore color reproduction area of the green area becomes smaller than the color reproduction area via additive color process.

Therefore, toner giving minimized color turbidity and clear hue has been desired via subtractive color process in the full color image forming.

On the other side, for example, full color image forming method using six or more color toners including orange toner and green toner in addition to conventional four color toners composed of yellow toner, magenta toner, cyan toner and black toner is proposed as one of technologies to enlarge color reproduction area in the full color image forming method via subtractive color process. That is, hue represented through 360° by Munsell hue circle is not reproduced by three color toners of yellow toner, magenta toner and cyan toner, but color reproduction area is enlarged by using orange toner and green toner in addition to three color toners.

For example, green toner composed of non-metal phthalocyanine pigment and isoindoline type pigment in combination is proposed (for example, Patent Document 1).

However, the toner composed of non-metal phthalocyanine pigment and isoindoline type pigment in combination causes color turbidity, and chroma and brightness are not sufficient.

It is preferable to add another toner as green toner to improve brightness and chroma in green area, to yellow toner and cyan toner. For this purpose, green toner giving high brightness and chroma is required. However, green toner using existing green pigment is added, it is difficult to obtain green area color reproduction of sufficient brightness.

PRIOR ART

Patent Document

Patent Document 1: JP A 2004-70089

SUMMARY

While various tests have been tried to enlarge the color reproduction area in the image forming via an electrophotography, they are not sufficient, particularly, in color reproduction performance of high brightness area of a green image which is a secondary color formed by a yellow toner and a cyan toner.

An object of the present invention is to dissolve the above described problems and to provide green toner for developing a static latent image which forms a green image having high brightness and high chroma used in an electrophotographic image forming method as well as a full color image forming method employing the green toner. The other object is to provide a green toner excellent in low temperature fixing performance.

EMBODIMENT TO PRACTICE THE INVENTION

Green toner for developing a static latent image comprising a binder resin and a colorant, wherein the colorant contains C.I. Solvent Green 5 and colorant compound X represented by Formula (1), and content ratio of C.I. Solvent Green 5 in whole amount of the colorant is 5 to 50% by weight.

Formula (1)

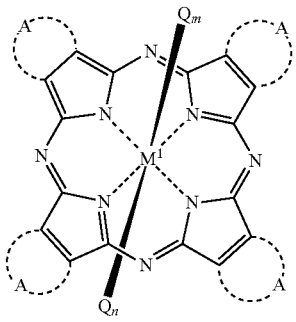

In Formula (1), $M^1$ is a metal atom of Group 14, Q is independently a monovalent substituent, m and n are each 0 or 1, at least one of m and n is 1, and A is independently an atomic group forming an aromatic ring which may have a substituent.

$M^1$ in Formula (1) of colorant compound X is preferably Si, Ge or Sn, and in particular, Si is preferable.

Each of Q in Formula (1) is preferably an alkyl group, an alkoxy group, an aryl group, an aryloxy group, an acyloxy group or a group represented by Formula (2), independently.

Formula (2)

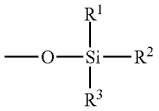

In Formula (2), $R^1$ through $R^3$ represents independently an alkyl group, an aryl group, an alkoxy group or an aryloxy group.

The amount of C.I. Solvent Green 5 in a total amount of the colorant is preferably 10 to 40% by weight.

The green toner may be used in a full color image forming method in combination with yellow toner, magenta toner, cyan toner and black toner.

Advantage of the Invention

According to the present invention, a green image having high brightness and chroma and minimized color turbidity can be obtained, and further a green toner excellent in low temperature fixing performance and a full color image forming method can be obtained.

BRIEF DESCRIPTION OF THE DRAWING

FIG. 1 is a schematic cross-sectional view of an example of a full color image forming apparatus used for the full color image forming method of the present invention.

Embodiment Practicing Invention

A green image with higher chroma and brightness can be obtained by forming a green image employing a green toner than secondary color green image formed by a yellow toner and a cyan toner in general. However conventional green colorant is not always sufficient in chroma, brightness and hue. A green toner can be prepared by blending a yellow colorant and a cyan colorant, and image of green area can be formed to dissolve the problem. Hue can be controlled optionally by changing blend ratio of the yellow colorant to the cyan colorant.

In a green image forming method using a green toner alone, high transfer efficiency is obtained since transfer efficiency relates to only green toner, and high quality image can be attained. On the other side, in the method via secondary color using a yellow toner and a cyan toner to form a green color; transfer efficiency is a product of respective transfer efficiency of yellow toner and cyan toner, and it is difficult to improve transfer efficiency in comparison with the green toner only.

Further, a green image is formed by green toner alone, a higher quality green image without color turbidity can be obtained since there is no redundant absorption in spectrum of green image in comparison with that the green image is formed by a secondary color formed by cyan toner and yellow toner which have different angle of hue.

A toner using two or more kinds of pigments has lower light reflectance in general, and has low brightness, color turbidity each pigments and low chroma. The present invention is to realize high chroma without color turbidity maintaining high brightness, by using a pigment in combination with a dye.

Toner using a dye as a colorant has high transparency and high brightness, and a toner having minimized color turbidity can be obtained. Further, a binder resin of the toner is compatible when oil soluble dye is used, a low molecular weight dye enters into a high molecular weight binder resin, and a binder resin is plasticized to reduce softening point. As the result, high intensity of fixing performance to a paper is realized at low fixing temperature. Hot offset may easily appear when only a dye is used as a colorant since softening point of the toner too much lowered.

Green toner and full color image forming method using the green toner having high brightness and chroma, and excellent low temperature fixing performance can be provided by using C.I. Solvent Green 5 and colorant compound X represented by Formula (1) according to the invention.

The invention is described in detail.

Green Toner

The green toner of this invention comprises a binder resin and a colorant, wherein the colorant contains C.I. Solvent Green 5 and colorant compound X represented by Formula (1), and a content ratio of C.I. Solvent Green 5 in the whole amount of the colorant is 5 to 50% by weight.

The content ratio of whole amount of colorant based on the binder resin is preferably 3 to 10% by weight.

The content ratio of C.I. Solvent Green 5 in the whole amount of the colorant is 5 to 50% by weight, and preferably 10 to 40% by weight. In case that the content of C.I. Solvent Green 5 satisfies this range, a green image having excellent in hue, chroma and brightness can be obtained.

The colorant C.I. Solvent Green 5 has characteristics reflecting light of wave length wave length region of 500 nm, and is recognized as yellow. It also emits fluorescent light of the same region of from 500 to 540 nm. It is presumed that an image having high brightness, chroma can be obtained it has strong intensity of yellow fluorescence in addition to reflection light.

C.I. Solvent Green 5 is called a dye and is dissolved in an organic solvent. It has characteristics to be dissolved in a binder resin by virtue thereof when contained in a toner, therefore, a toner having high transparency can be obtained and further it works to reduce softening point of the binder resin.

The toner according to this invention using C.I. Solvent Green 5 and a colorant compound X represented by Formula (1) has high transparency and high coloring power as the green toner, and as its result works as a green toner having high brightness and chroma.

Amount of C.I. Solvent Green 5 to add is preferably 0.001 to 15% by weight, and more preferably 0.01 to 2% by weight based on an amount of the binder resin. In case of not more than 0.001% by weight, sufficient coloring power and required image density are not obtained. In case of more than 15% by weight, color turbidity is caused and required hue is not obtained or, it gives too high image density, transparency reduces and image having adequate brightness is difficult to obtain.

The colorant compound X represented by Formula (1) has cyan color.

Formula (1)

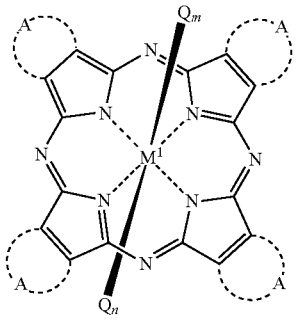

In Formula (1), $M^1$ is a metal atom of Group 14, Q is independently a monovalent substituent, m and n are each 0 or 1, at least one of m and n is 1, and A is independently an atomic group forming an aromatic ring which may have a substituent.

Colorant compound X is a compound having a bond from a center metal atom $M^1$ to a phthalocyanine ring in perpendicular direction, and it is not necessary that the bond be positioned at exactly 90° in colorant compound X.

Center metal atom $M^1$ in colorant compound X represented by Formula (1) is 14 group metal atom.

Specific examples of the center metal atom $M^1$ include Si, Ge and Sn, and Si is preferable in particular, to obtain sufficient coloring characteristics of high brightness color in cyan region.

In Formula (1) Q is independently a monovalent substituent, specifically an alkyl group, an aryl group, an aryloxy group, an alkoxy group, an acyloxy group or a group represented by Formula (2) is preferable, and more preferably an alkyl group having 1 to 22 carbon atoms, an aryl group having 6 to 18 carbon atoms, an aryloxy group having 6 to 18 carbon atoms, an alkoxy group having 1 to 22 carbon atoms, an acyloxy group having 2 to 30 carbon atoms, and a group represented by Formula (2) is included. Specifically, $—O(CH_2)_3CH_3$, $—O(t\text{-}C_4H_9)$, $—O(CH_2)_5CH_3$, $—O(CH_2)_7CH_3$, $—O(t\text{-}C_8H_{17})$, $—OC_6H_6$, $—OCO—CH_2CH_2CH_3$, $—OSi(CH_3)_3$, $—OSi(CH_2CH_3)_3$, $—OSi(CH_2CH_2CH_3)_3$, and the like are included.

It is preferable that at least one of Q is an alkyl group, an aryl group, an aryloxy group, an alkoxy group, an acyloxy group or a group represented by Formula (2), and more preferable that both of two Q are an alkyl group, an aryl group, an aryloxy group, an alkoxy group, an acyloxy group or a group represented by Formula (2). The group represented by Formula (2) is preferably among them.

Formula (2)

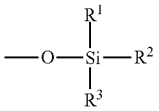

In Formula (2), $R^1$ through $R^3$ represents independently an alkyl group, an aryl group, an alkoxy group or an aryloxy group, preferably, an alkyl group having 1 to 22 carbon atoms, an aryl group having 6 to 18 carbon atoms, an alkoxy group having 1 to 22 carbon atoms, or an aryloxy group having 6 to 18 carbon atoms, and more preferably an alkyl group having 1 to 10 carbon atoms, an aryl group having 6 to 10 carbon atoms, an alkoxy group having carbon atoms 1 to 10, an aryloxy group having 6 to 10-carbon atoms, and further preferably an alkyl group having carbon atoms 2 to 8, an aryl group having 6 to 8 carbon atoms, an alkoxy group having 2 to 8-carbon atoms, or an aryloxy group having 6 to 8-carbon atoms, particularly preferably methyl group, ethyl group, n-propyl group, iso-propyl group, n-butyl group, isobutyl group and t-butyl group.

In the Formula (1), m and n for Q are each 0 or 1, and at least one of m and n is 1. This means the colorant compound X has at least one bond in perpendicular direction to a phthalocyanine ring.

In the Formulas (1) and (2), four A's are independently an atomic group to form an aromatic ring which may have a substituent. Specific examples of the atomic group include (A-1) through (A-7). Preferable examples are (A-1) and (A-2).

(A-1)

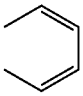

(A-2)

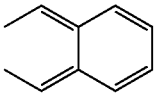

(A-3)

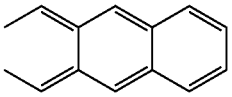

(A-4)

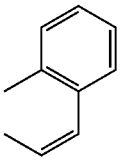

(A-5)

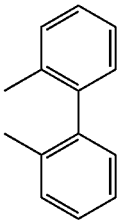

(A-6)

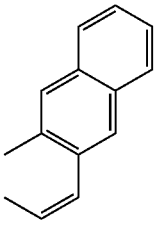

(A-7)

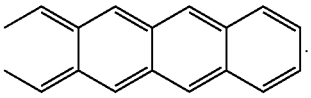

(A-1) through (A-7) may have a substituent.

A substituent in A includes an electron attractive group such as a chlorine atom, chlorohalogeno methyl group ($—CClX_2$) wherein X is a halogen atom, fluoromethyl group ($—CH_2F$), trifluoromethyl group ($—CF_3$) and nitro group ($—NO_2$), and an alkyl group having 4 to 8 carbon atoms such as t-butyl group and an alkoxy group such as $—O(CH_2)_7CH_3$.

Preferable examples of A in compounds represented by Formula (1) are listed.

(a-1)

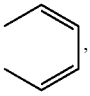

-continued
(a-2)
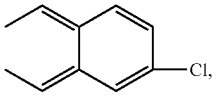
(a-3)
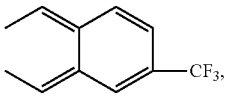
(a-4)
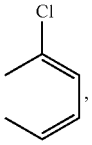
(a-5)
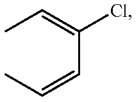
(a-6)
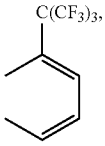
(a-7)
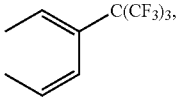
Among these, (a-1), (a-2) and (a-3) are particularly preferable.
Practical example of the colorant compound X represented by Formula (1) includes compound represented by formula (X-1) through formula (X-6).
X-1
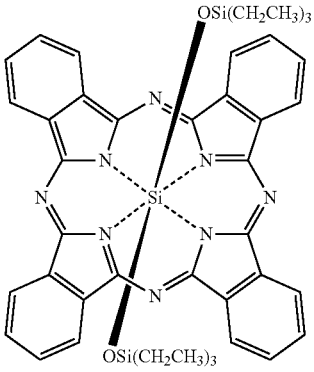
-continued
X-2
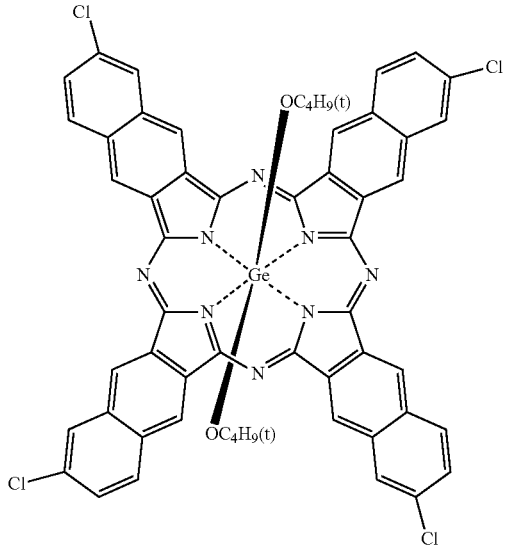
X-3
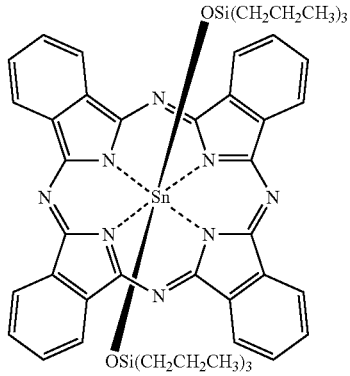
X-4
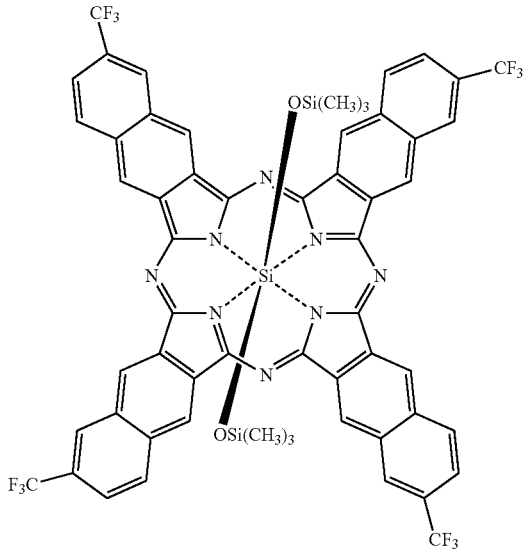

-continued

X-5

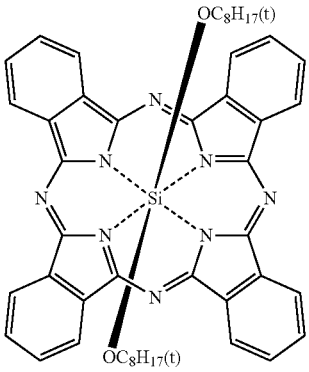

X-6

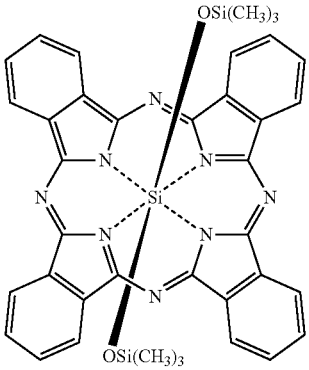

Particularly X-6 is preferable among these.

These compounds can be synthesized by a known method disclosed in such as U.S. Pat. No. 5,428,152, U.S. Pat. No. 4,927,735, U.S. Pat. No. 5,021,563, U.S. Pat. No. 5,219,706, U.S. Pat. No. 5,034,309, U.S. Pat. No. 5,284,943, U.S. Pat. No. 5,075,203, U.S. Pat. No. 5,484,685, U.S. Pat. No. 5,039,600, U.S. Pat. No. 5,438,135 and U.S. Pat. No. 5,665,875.

Content ratio of the colorant compound X is 50 to 95% by weight based on the binder resin is preferably, and more preferably 60 to 90% by weight in the green toner of this invention. In case that content of C.I. Solvent Green 5 is in excess, sufficient fluorescent emission cannot be obtained due to density extinction, and green image with high brightness cannot be formed. On the other side, the content of C.I. Solvent Green 5 is too less, sufficient fluorescent emission cannot be obtained, and a green image with high brightness cannot be formed.

Number average particle diameter of dispersion particles of the colorant compound X in toner is preferably 5 nm to 50 nm.

Another colorant than C.I. Solvent Green 5 and colorant compound X represented by Formula (1) may be used in combination with these colorants.

The colorant to be used in combination includes those which does not shift hue of green toner and does not damage chroma brightness. For example, it is preferable to select one having no absorption around 500 nm to around 540 nm in case to exhibit fluorescent effect by C.I. Solvent Green 5 remarkably. Specifically, C.I. Pigment Yellow 3, C.I. Pigment Yellow 35, C.I. Pigment Yellow 65, C.I. Pigment Yellow 74, C.I. Pigment Yellow 98, C.I. Pigment Yellow 111 and the like are cited. Further, a colorant showing cyan color may be used such as C.I. Pigment Blue 15:3.

L*a*b* Colorimetric System

L*a*b*colorimetric system is described.

L*a*b* colorimetric system is uniform color space defined by CIE (International Commission on Illumination), is a method preferably used to digitally express a color. In L*a*b* coordinate expressing color space by L*a*b* colorimetric system, L* axis direction represents brightness, a* axis direction represents hue in red-green direction, and b* axis direction represents hue in yellow-blue direction. The brightness refers to the relative brightness of a color, and the hue refers to color such as red, yellow, green, blue, or purple. The chroma refers to the degree of color vividness.

The larger L* shows brighter color and the smaller L* shows darker color. The larger absolute values of both a* and b* represents vivid color, and, a* and b* reached to 0, the color becomes dull. Color is specified by using L*, a*, b* digitally.

Chroma (C*) is used to express degree of vividness digitally other than brightness and hue, as calculated by a formula shown below.

$$\text{Chroma } C^* = \{(a^*)^2 + (b^*)^2\}^{1/2}$$

The chroma C* is larger, the more color is vivid.

Specifically, the L*a*b* for calculation of the hue angle is determined using the GTS; TAG MACBETH SPECTROLINO (manufactured by Gretag Macbeth) with conditions that D65 for reflections used as a light source, an aperture of 4 min in diameter measurement is used, at an interval of 10 nm in the range of 380 to 730 nm of the measuring wavelength, the viewing angle is set to 2 degrees, and an exclusive white tile is used for a reference.

Since L*, a*, b* and chroma C* derived from them vary depending to toner amount, the evaluation should be conducted with the same toner amount.

Binder Resin

A binder resin usually used in atones can be used in the green toner.

In case the toner is manufactured via a pulverizing method the following resin may be employed; for example, a vinyl type resin such as a styrene type resin, a (meth)acryl type resin, a styrene-(meth)acryl type copolymer resin; a polyester type resin, a polyamide type resin, a polycarbonate resin, a polyether resin, a polyvinyl acetate type resin, a polysulfone resin, an epoxy resin, a polyurethane resin and a urea resin. These may be used alone or two or more in combination. Among these resins those having polar group are preferable since these have solubility high in C.I. Solvent Green 5.

In case the toner having each color is manufactured via such a method as a suspension polymerization method, an emulsion coagulation method and a mini-emulsion polymerization coagulation, various polymerizable monomers can be used as a polymerizable monomer to obtain a binder resin composing toner particles, for example, a vinyl monomer.

Examples of polymerizable monomers for forming a binder resin include vinyl monomer, specifically, styrenes or styrene derivatives such as styrene, o-methyl styrene, m-methyl styrene, p-methyl styrene, α-methyl styrene, p-chloro styrene, 3,4-dichlorostyrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, p-n-dodecyl styrene;

methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate, and dimethyl aminoethyl methacrylate;

vinyl halide such as vinyl chloride, vinylidene chloride, vinyl bromide, vinyl fluoride, and vinylidene fluoride;

vinyl esters such as vinyl propionate, vinyl acetate, and vinyl benzoate;

vinyl ethers such as vinyl methyl ether, and vinyl ethyl ether;

vinyl ketones such as vinyl methyl ketone, vinyl ethyl ketone, and vinyl hexyl ketone;

N-vinyl compounds such as N-vinyl carbazole, N-vinyl indole, and N-vinyl pyrrolidone;

vinyl compounds such as vinyl naphthalene and vinyl pyridine; and acrylic acid derivatives or methacrylic acid derivatives such as acrylonitrile and acryl amide.

These vinyl monomers used alone or two or more in combination.

It is preferable to use a polymerizable monomer having an ionic dissociation group in combination with the polymerizable monomer to obtain a binder resin. The polymerizable monomer having an ionic dissociation group contains a substitution group such as carboxyl group, sulfonic acid group and phosphoric acid group, and practical example includes acrylic acid, methacrylic acid, maleic acid, itaconic acid, cinnamic acid, fumaric acid, monoalkyl maleate ester, monoalkyl itaconate ester, styrene sulfonic acid, allyl sulfosuccinic acid, 2-acryl amide-2-methyl propane sulfonic acid, acid phosphooxyethyl methacrylate, and 3-chloro-2-acid phosphooxypropyl methacrylate.

Further, the resin of the crosslinking structure can be formed by using multifunctional vinyls such as divinyl benzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

Each of toners used for the full color image forming method may contain an inner additive and an external additive such as a charge controlling agent and a releasing agent, as required.

Charge Controlling Agent

A positive or negative charge controlling agent can be used in the cyan toner. The charge controlling agent is preferably colorless.

Amount of the charge controlling agent used in the cyan toner particles is preferably 0.01 to 30 parts by mass and more preferably 0.1 to 10 parts by mass based on 100 parts by mass of a binder resin of the cyan toner particles.

Releasing Agent

Various type of wax may be uses as a releasing agent Examples of wax include polyolefin wax such as polyethylene wax and polypropylene wax; branched chain hydrocarbon wax such as microcrystalline wax, long chain hydrocarbon wax such as paraffin wax and Sazol wax; dialkyl ketone wax such as distearyl ketone; ester wax such as carnauba wax, montan wax, trimethylol propane tribehenate, pentaerythritol tetrabehenate, pentaerythritol diacetate dibehenate, glycerin tribehenate, 1,18-octadecane diol distearate, tristearyl trimellitate, and distearyl maleate; amide wax such as ethylene diamine behenylamide and tristearylamide trimellitate.

Content of the releasing agent is preferably 0.1 to 30 parts by weight, and more preferably 1 to 20 parts by weight based on 100 parts by weight of the binder resin.

External Additive

The cyan toner may be prepared by adding a fluidizing agent and a cleaning aids so called as post-treating agent to the cyan color particles for improving the fluid ability, charging property and cleaning suitability, although the green color particles may be used as a green toner without any treatment.

As the external additive, for example, an inorganic oxide fine particle such as fine particle of silica, alumina and titanium oxide; a fine particle of metal stearate such as fine particle of aluminum stearate and zinc stearate; and a fine particle of inorganic titanate such as a fine particle of strontium titanate and zinc titanate are cited.

These inorganic particles are preferably treated on the surface thereof by a silane coupling agent, a titanium coupling agent, a higher fatty acid or silicone oil for improvement in the storage ability against heating and the stability against environmental condition.

The adding amount of such the external additives is from 0.05 to 5, and preferably from 0.1 to 3, parts by weight in total to 100 parts by weight of the cyan toner. The various combinations of the external additives may be applied.

Manufacturing Method of Toner

The green toner used in the full color image forming method can be manufactured by obtaining toner particles by employing a binder resin and a colorant, and further if necessary an inner additives, and adding an external additive, if necessary, to the toner particles.

The method for producing the color tone's includes a kneading and pulverization method, a suspension polymerization method, an emulsion polymerization method, an emulsion polymerization and aggregation method, a mini emulsion polymerization and aggregation method, and an encapsulation method. Of these, the emulsion polymerization and aggregation method is preferably used, in consideration that it is necessary to obtain toners composed of small-sized particles to achieve a high quality image in view of production cost and production stability.

The emulsion coagulation method is a method of manufacturing toner particles in which dispersion liquid of microparticles of a binder resin (referred to "binder resin microparticles") prepared by emulsification is mixed with a dispersion liquid of microparticles of a colorant (referred to "colorant microparticles"), and the mixture is subjected to coagulation treatment so that microparticles have intended toner particle diameter, and further shape of the microparticles is controlled by fusion of a binder resin microparticles. Microparticles of the binder resin may contain optionally a releasing agent, a charge controlling agent and the like.

An emulsion coagulation method is shown as an example of manufacturing method of toner.

(E1) A step of preparing dispersion liquid in which colorant microparticles are dispersed in an aqueous medium.

(E2) A step of preparing dispersion liquid in which binder resin microparticles, containing inner additives if necessary, are dispersed in an aqueous medium.

(E3) A step of forming toner particles by coagulation/fusion of colorant microparticles and binder resin microparticles by mixing dispersion liquid of colorant microparticles with dispersion liquid of binder resin microparticles.

(E4) A step of removing surfactant and the like by filtering toner particles from dispersion of toner particles in an aqueous medium.

(E5) A step of drying toner particles.

(E6) A step of adding an external additive to toner particles.

It is preferable to employ emulsion polymerization particles dispersion liquid obtained by emulsion polymerization as a method for dispersing binder resin microparticles in step (E2). The binder resin microparticles may have a multilayer structure composed of two or more layers composed of binder resins having different component. The binder resin microparticles having such structure, for example, those having two layers, can be obtained by a method comprising steps of preparing dispersion liquid of resin particles using an usual emulsion polymerization process (first step polymerization), adding a polymerization initiator and a polymerizable monomer to the dispersion liquid and polymerizing these (Second step polymerization).

Toner particles having core-shell structure can be obtained by the emulsion coagulation method, specifically, toner particles having core-shell structure can be obtained by a method in which, first, binder resin microparticles and colorant microparticles for a core particle are subjected to coagulation/fusion to prepare a core particle, then, binder resin microparticles for a shell layer are added into dispersion liquid of the core particle so as to form a shell layer covering core particle surface by coagulation/fusion of binder resin microparticles for a shell layer on a surface of the core particle.

It is particularly preferable that the green toner used in a full color image forming method is obtained by a method comprising a step of mixing dispersion liquid dispersing colorant microparticles in an aqueous medium and dispersion liquid dispersing binder resin microparticles in an aqueous medium, and a step of coagulation/fusion of colorant microparticles and binder resin microparticles, that is, a manufacturing method such as an emulsion coagulation method.

Particle diameter of colorant microparticles in a step (E1) of preparing dispersion liquid is preferably 10 to 300 nm in terms of volume-based median diameter. It is preferable to heat at a temperature higher than the glass transition point of binder resin microparticles by 30° C. or more for 90 minutes or longer in a step (E3) of forming toner particles. According to this dissolution of a yellow colorant C.I. Solvent Green 5 in a binder resin can be accelerated. Measuring dispersion particle diameter in colorant dispersion liquid Dispersion particle diameter of colorant microparticles in an aqueous medium is number average particle diameter, i.e., median diameter (D50) in number distribution, and the median diameter is measured via MICROTRAC UPA-150 (produced by HONEYWELL Corp.). Measuring Condition (1) Sample refractive index: 1.59

(2) Sample specific gravity: 1.05 (in terms of a spherical particle)

(3) Solvent refractive index: 1.33

(4) Solvent viscosity: $0.797C10^{-3}$ Pa·s at 30° C. and $1.002C10^{-3}$ Pas at 20° C.

Zero-point adjustment was conducted by placing ion-exchanged water in a measuring cell.

An example of manufacturing method of the green toner employing pulverizing method is shown.

(P1) A step of mixing a binder resin, a colorant and an inner additive, if necessary, via Henschel Mixer or the like.

(P2) A step of kneading obtained composition by an extrusion kneading machine or the like with heating.

(P3) A step of pulverizing treatment of rough pulverizing obtained kneaded material by a hammer mill or the like, and then further pulverizing by a turbo mill pulverizer or the like.

(P4) A step of forming toner particles by powder classification process of the obtained pulverized material via an air sifter utilizing Coanda effect.

(P5) A step of adding an external additive to toner particles.

It is preferable that kneading is conducted at a temperature higher than the softening point of the binder resin by 15° C. or more in the step (P2) of kneading a binder resin and a colorant. According to this, dissolution of C.I. Solvent Green 5 in a binder resin can be accelerated.

Particle Diameter of Cyan Toner

In the toner of the present invention, the particle diameter of toner particles is preferably a volume-based median diameter of 4 to 10 pin, and more preferably 6 to 9 μm.

High transfer efficiency is obtained and excellent image of half tone, fine lines and dot is obtained, by controlling volume-based median diameter within the above range.

The volume-based median diameter (D50v) of toner particles can be determined using COULTER MULTISIZER 3 (Beckmann Coulter, Inc.), connected to a computer system for data processing software V3.51 (Beckmann Coulter, Inc.).

Specifically, 0.02 g of the cyan toner is added in 20 ml of a surfactant solution (being a surfactant solution prepared, for example, via ten-fold dilution of a neutral detergent containing a surfactant component with purified water to disperse a toner), followed by being wetted and then subjected to ultrasonic dispersion for 1 minute to prepare a toner dispersion. The toner dispersion is injected into a beaker, containing electrolyte solution "ISOTON II" (produced by Beckman Coulter, Inc.), set on the sample stand, using a pipette until the concentration indicated by the measuring apparatus reaches 8%. Herein, this concentration range makes it possible to obtain highly reproducible measurement values. Using the measuring apparatus, under conditions of a measured particle count number of 25,000 and an aperture diameter of 100 μm, the frequency is calculated by dividing a measurement range of 2 to 60 μm into 256 parts, and the particle diameter at a 50% point from the higher side of the volume accumulation ratio (namely the volume $D_{50}$% diameter) is designated as the volume-based median diameter.

Softening Point of Toner

Softening point (Tsp) of toner is preferably 70 to 130° C. and more preferably 70 to 120° C. Colorants composing each color toner have stable characteristics without shifting spectrum caused by affect of heat, however, affect due to heat during fixing process can be reduced by controlling the softening point in a range as described. Therefore, wider and more stable color reproduction performance is expected to exhibit since an image can be formed without loading a colorant.

Image forming with reduced electric power and friendly to environment can be realized since image fixing is conducted with lower temperature than the conventional toners by using toner having softening point (Tsp) within the above described range.

As methods to regulate the softening point (Tsp) of the toner, exemplified methods are described below. Namely, listed are (1) a method to control the types of monomers composing resins employed in formation of specific resin particles, and composition ratios of monomers in copolymers, (2) a method to regulate the degree of polymerization by controlling the amounts of polymerization initiators and chain transfer agents, and (3) a method to control the types and amounts of a release agent.

Measuring Softening Point

A method of measuring the softening point (Tsp) of a toner follows. Specifically, "FLOW TESTER CFT-500" (produced by Shimadzu Corp.) is used. A column of toner is formed to a height of 10 mm, and a load of $1.96C10^{6}$ Pa is applied to it employing a plunger, heated at a temperature increase rate of 6° C./minute so that the toner is allowed to be extruded, whereby a curve (a softening fluid curve) between the plunger's descent amount and temperature of the above flow tester is plotted, and the initial outflow temperature is designated as a melt initiating point, while the temperature for a descent of 5 mm is designated as the softening point.

Glass Transition Point of Toner

The glass transition temperature (Tg) of the toner is preferably from 20 to 90° C., more preferably from 3.1 to 65° C.

Measuring Glass Transition Point

The glass transition temperature (Tg) of the cyan toner is determined using differential scanning calorimeter DSC-7 (produced by Perkin Elmer, Inc.) and thermal analyzer controller "TAC7/DX" (produced by Perkin Elmer, Inc.).

Specifically, 4.5 mg of the cyan toner is sealed in an aluminum pan (Kit No. 0219-0041) and placed in a DSC-7 sample holder. An empty aluminum pan is used as the reference measurement. Subsequently, heating-cooling-heating temperature control is =Tied out over a measurement temperature range of 0 to 200° C. under measurement conditions of a temperature increasing rate of 10° C./min and a temperature decreasing rate of 10° C./min. Measured data is obtained during the second heating stage.

Then a glass transition point (Tg) is obtained as a value which is read at the intersection of the extension of the base line, prior to the initial rise of the first endothermic peak, with the tangent showing the maximum inclination between the initial rise of the first endothermic peak and the peak summit.

Developer

The green toner of the invention may be used not only as non-magnetic one-component developer but also a two-component developer by mixing with a carrier.

When the green toner of the invention is used as the two-component developer, a magnetic particle composed of a metal such as iron, ferrite and magnetite and an alloy composed of such the metal and aluminum can be used as the carrier, and the ferrite particle is particularly preferable. A coated carrier composed of the magnetic particle coated with a coating material such as a resin and a binder type carrier composed of binder resin in which the magnetic particles are dispersed may also be used as the carrier. As the coating resin constituting the coated carrier, for example, an olefin type resin, styrene type resin, styrene-acryl type resin, silicone type resin, ester type resin and fluororesin are cite. As the resin constituting the resin dispersion type carrier, for example, a styrene-acryl type resin, polyester resin, fluororesin and phenol resin are usable.

The volume-based median diameter of the carrier is preferably from 20 to 100 μm and more preferably from 20 to 60 μm.

The volume-based median diameter of the carrier can be typically determined by a laser diffraction particle size distribution measuring apparatus having a wet type disperser HEROS, manufactured by Sympatec GmbH.

Transfer Material

Transfer material used in the image forming method using green toner according to the includes a plain paper or a high-quality paper of various thickness, a coated printing paper such as an art paper and a coated paper, a commercial Japanese paper or a postcard, a plastic sheet for OHP use or cloth.

Image Forming Method

The green toner of the invention is used preferably in a full color image forming method using six color toners together with a yellow toner, a magenta toner, a cyan toner, a black toner and an orange toner.

FIG. 1 shows a cross sectional view of an example of the full color image forming apparatus practicing the full color image forming method.

The full color image forming apparatus is provided with an intermediate transfer member having an endless shape (referred to "intermediate transfer belt") 17 arranged by supporting rollers 17*a* through 17*d*, six toner image forming units 30Y, 30Or, 30M, 30C, 30G, 30K forming an yellow toner image, an orange toner image, a magenta toner image, a cyan toner image, a green toner image and a black toner image, respectively, are arranged in the periphery of the intermediate transfer belt 17, so that the intermediate transfer belt 17 is circularly moved contacting to each of electrostatic latent image carrying photoreceptor drums 10Y, 10Or, 10M, 10C, 10G, 10K in the each of toner image forming unit with a separated space.

Toner image forming unit 30Y concerning to a yellow toner image comprises rotating photoreceptor drum 10Y, and charging member 11Y, exposing member 12Y, developing member 13Y, first transfer member 14Y and cleaning member 20Y arranged around the peripheral of the photoreceptor drum 10Y, respectively, in a rotating direction photoreceptor drum 10Y in an operation order.

First transfer member 14Y is composed of first transfer roller 141Y arranged to form a first transfer area (first transfer nip portion) by suppressing to a photoreceptor drum 10Y via intermediate transfer belt 17 and a transfer electric power supplying member (not shown) connected to first transfer roller 141Y, wherein transfer electric power field is formed when predetermined quantity of transfer electric power is supplied to first transfer roller 141Y by the transfer electric power supplying member, yellow toner image formed on photoreceptor drum 10Y is first transferred on intermediate transfer belt 17 by the transfer electric power field.

Other toner image forming units 30Or, 30M, 30C, 30G and 30K are the same as toner image forming unit 30Y concerning to yellow toner image except that each developer contains orange toner, magenta toner, cyan toner, green toner and black toner, respectively in place of yellow toner. The same structural parts in the same toner image forming unit 30Y concerning to yellow toner image is shown same symbol replacing "Y" with "Or", "M", "C", "G" and "K", respectively for a convenience, in FIG. 1.

Second transfer member 14S is provided in down stream direction of a toner image forming unit arranged area in moving direction of intermediate transfer belt 17 (shown by arrow in FIG. 1).

Second transfer member 14S is composed of second transfer roller 141S arranged to form a second transfer area (a second transfer nip portion) pressed via intermediate transfer belt 17 to one of supporting rollers backup miler 17*d* supporting intermediate transfer belt 17 and transfer voltage applying member (not shown) connecting to second transfer roller 141S. Transfer electric power field is formed by applying second transfer bias voltage having a polarity reverse to first transfer toner image to a second transfer roller 141S by this transfer voltage applying member. First transfer toner image formed on intermediate transfer belt 17 is transferred to transfer material P by the transfer electric power field.

In FIG. 1 numeral 18 shows a fixing device for fixing toner image on transfer material P transferred from second transfer area, and is composed of, for example, heating roller 181 provided with a heating source inside thereof and pressure roller 182 arranged in a pressed state so as to form a fixing nip portion.

Symbol 20S shows a cleaning member for an intermediate transfer member equipped with a cleaning blade removing untransferred toner on intermediate transfer belt 17, and arranged at a portion in the down stream of a second transfer area in moving direction of intermediate transfer belt 17.

In the full color image forming apparatus as described, each color toner image formed on photoreceptor drum 10Y, 10Or, 10M, 10C, 10G and 10K, in each toner image forming units 30Y, 30Or, 30M, 30C, 30G and 30K, respectively, is at first transferred onto intermediate transfer belt 17 in order and is superposed, a toner image first transferred on intermediate transfer belt 17 are second transferred on transfer material P by second transfer member 14S, a color toner image is formed on transfer material P by heating with pressure via fixing device 18.

EXAMPLE

The invention is described in detail by examples.

Preparation Example of Colorant Microparticle Dispersion 1

Sodium n-dodecyl sulfate in an amount of 43.75 parts by weight was charged into ion-exchanged water 1,000 parts by weight of water, dissolved and stirred, and aqueous solution of a surfactant was prepared. Into the aqueous solution of a surfactant 125 parts by weight of Compound X-1 was gradually added, it was subjected to dispersing treatment by SC Mill (produced by NIPPON COKE & ENGINEERING. CO., LTD) for one hour, and colorant microparticle dispersion 1 was prepared.

Preparation Example of Colorant Microparticle Dispersions 2 Through 6

Colorant microparticle dispersions 2 through 6 were obtained in the similar manner to manufacturing example of colorant microparticle dispersion 1 except that Compound X-1 was replaced with Compound X-2 through Compound X-6, respectively.

Preparation Example of Colorant Microparticle Dispersion 7

Colorant microparticle dispersion 7 was prepared in the similar manner to manufacturing example of colorant microparticle dispersion 1 except that Compound X-1 was replaced with C.I. Solvent Green 5 (SUMIPLAST Yellow FL7G, produced by Sumika Chemtex Company, Limited).

Preparation Example of Colorant Microparticle Dispersion 8

Colorant microparticle dispersion 8 was prepared in the similar manner to manufacturing example of colorant microparticle dispersion 1 except that Compound X-1 was replaced with C.I. Pigment Blue 15:3 (copper phthalocyanine, produced by DCI Corp.).

Preparation Example of Colorant Microparticle Dispersion 9

Colorant microparticle dispersion 9 was prepared in the similar manner to manufacturing example of colorant microparticle dispersion 1 except that Compound X-1 was replaced with C.I. Pigment Blue 16 (non-metal phthalocyanine pigment).

Preparation Example of Colorant Microparticle Dispersion 10

Colorant microparticle dispersion 10 was prepared in the similar manner to manufacturing example of colorant microparticle dispersion 1 except that Compound X-1 was replaced with C.I. Solvent Green 7.

Preparation Example of Colorant Microparticle Dispersion 11

Colorant microparticle dispersion 11 was prepared in the similar manner to manufacturing example of colorant microparticle dispersion 1 except that Compound X-1 was replaced with C.I. Pigment Yellow 74.

Preparation Example of Colorant Microparticle Dispersion 9

Colorant microparticle dispersion 9 was prepared in the similar manner to manufacturing example of colorant microparticle dispersion 1 except that Compound X-1 was replaced with C.I. Pigment Yellow 185 (PALIOTOL YELLOW L1155, produced by BASF SE).

The colorant microparticle dispersions described above are summarized in Table 1.

TABLE 1

| Colorant microparticle dispersion | Colorant | Amount (Parts by weight) | Ion exchanged water (Parts by weight) |
|---|---|---|---|
| 1 | Formula (1) Colorant X-1 | 125 | 1,000 |
| 2 | Formula (1) Colorant X-2 | 125 | 1,000 |
| 3 | Formula (1) Colorant X-3 | 125 | 1,000 |
| 4 | Formula (1) Colorant X-4 | 125 | 1,000 |
| 5 | Formula (1) Colorant X-5 | 125 | 1,000 |
| 6 | Formula (1) Colorant X-6 | 125 | 1,000 |
| 7 | C.I. Solvent Green 5 | 125 | 1,000 |
| 8 | C.I. Pigment Blue 15:3 | 125 | 1,000 |
| 9 | C.I. Pigment Blue 16 | 125 | 1,000 |
| 10 | C.I. Solvent Green 7 | 125 | 1,000 |
| 11 | C.I. Pigment Yellow 74 | 125 | 1,000 |
| 12 | C.I. Pigment Yellow 185 | 125 | 1,000 |

Manufacturing Example of Green Toner 1

(1) Manufacturing Example of Resin Particles (a) First Step Polymerization

A 5,000 ml four-neck flask fitted with a thermal sensor, a cooling pipe, a nitrogen introducing unit, and a stirrer was charged with 4 parts by weight of polyoxyethylene-2-sodium dodecylbenzenesulfonate together with 3,040 parts by weight of ion-exchanged water, and aqueous solution of a surfactant was prepared.

Polymerization initiator solution of 10 parts by weight of potassium persulfate dissolved in 400 parts by weight of ion-exchanged water was added to the aqueous solution of a surfactant, and temperature was raised to 75° C., then polymerizable monomer mixture composed of the following compounds was dripped into the reaction vessel taking one hour.

| | |
|---|---|
| Styrene | 532 parts by weight |
| n-Butylacrylate | 200 parts by weight |
| Methacrylic acid | 68 parts by weight |
| n-Octylmercaptan | 16.4 parts by weight |

After completion of dripping polymerizable monomer mixture, first step polymerization was conducted by heating at 75° C. for two hours, Resin particles A1 was manufactured.

(b) Second Step Polymerization

Into a flask fitted with a stirring unit, charged was a polymerizable monomer solution composed of polymerizable monomer mixture composed of the following compounds, and releasing agent 93.8 parts by weight of paraffin wax HNP-57 (produced by Nippon Seiro Co., Ltd.) was added, and was dissolved by heating at 90° C.

| | |
|---|---|
| Styrene | 101.1 parts by weight |
| n-Butylacrylate | 62.2 parts by weight |
| Methacrylic acid | 12.3 parts by weight |
| n-Octylmercaptan | 1.75 parts by weight |

Aqueous solution or a surractant was prepared by dissolving parts by weight of anionic surfactant sodium polyoxyethylene-2-dodecylethersulfonate in 1,560 parts by weight ion-exchanged water and heated to 98° C. To the aqueous solution of a surfactant 32.8 parts by weight of Resin particles A1 (in terms of solid substance) was added, after polymerizable monomer mixture containing paraffin wax was added, and they were subjected to mixing and dispersing for 8 hours by employing mechanical dispersion apparatus "CLEARMIX" manufactured by M Techniques, and emulsified particle dispersion liquid containing emulsified particles having particle diameter of 340 nm was prepared dispersion.

Subsequently, polymerization initiator solution dissolving 6 parts by weight potassium persulfate in 200 parts by weight ion-exchanged water was added to emulsified particle dispersion liquid, and Second step polymerization by heating with stirring at 98° C. for 12 hours, and resin particles A2 was manufactured.

(c) Third Step Polymerization resin particles A2, Polymerization initiator solution dissolving 5.45 parts by weight of potassium persulfate in 220 parts by weight of ion-exchanged water was added to resin particles A2, and polymerizable monomer mixture composed of compounds described below was added at 80° C. taking one hour.

| | |
|---|---|
| Styrene | 293.8 parts by weight |
| n-Butylacrylate | 154.1 parts by weight |
| n-Octylmercaptan | 7.08 parts by weight |

After dripping the polymerizable monomer mixture, third step polymerization was conducted by heating with stirring for two hours, and Resin Particles 1 was manufactured by cooling to 28° C.

(d) Step of Preparing Shell Resin Particles (a) Shell resin particles were manufactured in the same manner as the first step polymerization except that monomer mixture was changed to those described below.

| | |
|---|---|
| Styrene | 624 parts by weight |
| 2-Ethylhexyl acrylate | 120 parts by weight |
| Methacrylic acid | 56 parts by weight |
| n-Octylmercaptan | 16.4 parts by weight |

(2) Manufacturing Example of Green Toner Particles

The following compounds were charged in a reaction vessel and stirred.

| | |
|---|---|
| Resin particles 1 | 420 parts by weight |
| Ion-exchanged water | 900 parts by weight |
| Colorant microparticle dispersion 1 | 14 parts by weight |
| Colorant microparticle dispersion 7 | 6 parts by weight |

After adjusting temperature inside of the reaction vessel at 30° C., pH was controlled at 8 to 11 by adding 5 mol/L aqueous solution of sodium hydroxide.

Subsequently, further thereto, an aqueous solution of 50 parts by mass of magnesium chloride hexahydrate dissolved in 50 parts by weight of deionized water was added at 30° C. for 10 min. After allowed to stand for 3 minutes, the mixture was heated to 80° C. taking 60 minutes to perform coagulation.

Using MULTISIZER 3 COULTER COUNTER (produced by Beckman Coulter, Inc.), the dispersion was measured as such with respect to coagulated particle size and when coagulated particles reached a volume-based median diameter of 6.0 μm, there was added an aqueous solution of 40.2 parts by mass of sodium chloride dissolved in 1,000 parts by mass of deionized water to terminate coagulation.

After terminating coagulation, ripening was conducted at 70° C. for 1 hour to allow fusion to continue, whereby core portion 1 was prepared.

The average circularity of the core portion 1, which was measured by FPIA 2000 (produced by SYSTEX Co. Ltd.), was 0.912.

(b) Formation of Shell

Next, to the foregoing solution maintained at 65° C. was added 80 parts by mass of shell resin particles 1. Further thereto, an aqueous solution of 50 parts by mass of magnesium chloride hexahydrate dissolved in 50 parts by mass of deionized water was added taking 10 minutes and the reaction mixture was heated to 70° C. and stirred for 1 hour. Thus, the shell resin particle 1 was fused onto the surface of the core particle 1 and ripening was carried out for 20 minutes to form a shell.

Thereafter was added an aqueous solution of 40.2 parts by mass of sodium chloride dissolved in 1,000 parts by mass to terminate shell formation. The reaction mixture was cooled to 30° C. at a cooling rate of 8° C./min. The colored particles thus formed were filtered off and repeatedly washed with deionized water of 45° C., and dried with hot air of 40° C. to form green toner particles 1 having shell on the core surface.

(3) Example of Addition of External Additive

External additives described below were added to 100 parts by weight green toner particles 1, external additive treatment was conducted using Henschel Mixer, produced by Mitsui Miike Mining Co., Ltd., and green toner 1 was manufactured.

| | |
|---|---|
| Hexamethyl silazane-treated silica (average primary particle diameter of 12 nm | 0.6 parts by weight |
| n-Octylsilane-treated titanium oxide (average primary particle diameter of 24 nm) | 0.8 parts by weight |

Volume based median diameter of the manufactured green toner 1 was 6.5 μm, and softening point of 107° C. The external treatment by HENSCHEL mixer was conducted under conditions of a stirring blade circumferential speed of 35 msec, a treatment temperature of 35° C. and a treatment time of 15 min.

Manufacturing Example of Green Toner 2 Through 6

Green toner 2 was manufactured in the same way as green toner 1 except that the colorant microparticle dispersion 2 was used in "(2) manufacturing example of green toner particles" of manufacturing example of green toner 1. Green toners 3 through 6 were manufactured in the same way using the colorant microparticle dispersions 3 through 6, respectively.

Manufacturing Example of Green Toner 7

Green toner 7 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 18.4 parts by weight |
| Colorant microparticle dispersion 7 | 1.6 parts by weight |

Manufacturing Example of Green Toner 8

Green toner 8 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 11.0 parts by weight |
| Colorant microparticle dispersion 7 | 9.0 parts by weight |

Manufacturing Example of Green Toner 9

Green toner 9 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 18.0 parts by weight |
| Colorant microparticle dispersion 7 | 2.0 parts by weight |

Manufacturing Example of Green Toner 10

Green toner 10 was manufactured by the same way as green toner 1, except that the colorant microparticle dispersion was replaced by the composition as follows in "(2) manufacturing example of green toner particles" of manufacturing example of preen toner 1.

| | |
|---|---|
| Colorant microparticle dispersion 1 | 12.0 parts by weight |
| Colorant microparticle dispersion 7 | 8.0 parts by weight |

Manufacturing Example of Green Toner 11

Green toner 11 was manufactured by a pulverizing method described below.

(1) Blending Step

The toner composition materials described below were placed in HENSCHEL mixer (produced Mitsui Mining Co., Ltd.) and blended with stirring at a blade-circumferential speed of 25 m/second for 5 minutes.

| | |
|---|---|
| Polyester resin (condensation product of bisphenol A/ethylene oxide adduct, terephthalic acid and trimellitic acid having a weight average molecular weight of 20,000) | 100 parts by weight |
| Colorant 1 (Compound X-1) | 7.0 parts by weight |
| Colorant 2 (C.I. Solvent Green 5) | 3.0 parts by weight |
| Releasing agent (Pentaerythritol tetrastearate) | 6.0 parts by weight |
| Charge controlling agent (LR-147, manufactured by Japan Carlit Co., Ltd.) | 1.0 part by weight |

(2) Kneading Step

The blended material was kneaded by a double-spindle extruder at 110° C., and was cooled.

(3) Pulverizing Step

Kneaded material was pulverized roughly by Hammer Mill (produced by Hosokawa Micron Corp.), and then was pulverized finely by TURBO MILL T-400 (produced by TURBO KOGYO CO., LTD.).

A colorant dispersed in particles had number average particle diameter of 200 nm.

(4) Classification Step

The obtained fine powder was subjected to fine powder classification treatment by an air classifier to obtain colored particles having a volume-based median diameter of 6.5 μm.

(5) Adding External Additive Step

The following external additives were added to 100 parts by weight of the green toner particles, and subjected to an external treatment using Henschel Mixer and green toner 11 was manufactured.

| | |
|---|---|
| Hexamethyl silazane-treated silica (average primary particle diameter of 12 nm) | 0.6 parts by weight |
| n-Octylsilane-treated titanium oxide (average primary particle diameter of 24 nm) | 0.8 parts by weight |

The external treatment by HENSCHEL mixer was conducted under conditions of a stirring blade circumferential speed of 35 m/sec, a treatment temperature of 35° C. and a treatment time of 15 min.

Manufacturing Example of Green Toner 12

Green toner 12 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 19.8 parts by weight |
| Colorant microparticle dispersion 7 | 0.2 parts by weight |

Manufacturing Example of Green Toner 13

Green toner 13 was manufactured by the same way as green toner 1, except that the colorant microparticle dispersion was replaced by the composition as follows in "(2)

manufacturing example of green toner particles" of manufacturing example of green toner 1.

| | |
|---|---|
| Colorant microparticle dispersion 1 | 9.0 parts by weight |
| Colorant microparticle dispersion 7 | 11.0 parts by weight |

Manufacturing Example of Green Toner 14

Green toner 14 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 8 | 14.0 parts by weight |
| Colorant microparticle dispersion 7 | 6.0 parts by weight |

Manufacturing Example of Green Toner 15

Green toner 15 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 14.0 parts by weight |
| Colorant microparticle dispersion 11 | 6.0 parts by weight |

Manufacturing Example of Green Toner 16

Green toner 16 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 9 | 10.0 parts by weight |
| Colorant microparticle dispersion 12 | 10.0 parts by weight |

This sample contains a colorant corresponding the green toner colorant disclosed by Patent Document 1 (JP-A 2004-70089).

Manufacturing Example of Green Toner 17

Green toner 17 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 10 | 20.0 parts by weight |

Manufacturing Example of Yellow Toner 18

Yellow toner 18 was manufactured by the same way as green toner 1, except that Colorant microparticle dispersion 1 was not used and the colorant microparticle dispersion was replaced by the composition as follows in "(2) manufacturing example of green toner particles" of manufacturing example of green toner 1.

| | |
|---|---|
| Colorant microparticle dispersion 7 | 20.0 parts by weight |

Manufacturing Example of Cyan Toner 19

Yellow toner 18 was manufactured by the same way as green toner 1, except that the colorant microparticle dispersion was replaced by the composition as follows in "(2) manufacturing example of green toner particles" of manufacturing example of green toner 1.

| | |
|---|---|
| Colorant microparticle dispersion 1 | 20.0 parts by weight |

The colorant compositions used in the toners are shown in Table 2.

TABLE 2

| | Colorant microparticles Dispersion 1 | | | | Colorant microparticles dispersion liquid 2 | | | |
|---|---|---|---|---|---|---|---|---|
| | Colorant microparticles | | Amount | | Colorant microparticles | | Amount | |
| Toner No. | Dispersion No. | Colorant | Parts by weight | Content (%) | dispersion liquid No. | Colorant | Parts by weight | Content (%) |
| 1 | 1 | Compound X-1 | 14.0 | 70 | 7 | C.I. Solvent Green 5 | 6.0 | 30 |
| 2 | 2 | Compound X-2 | 14.0 | 70 | 7 | C.I. Solvent Green 5 | 6.0 | 30 |
| 3 | 3 | Compound X-3 | 14.0 | 70 | 7 | C.I. Solvent Green 5 | 6.0 | 30 |
| 4 | 4 | Compound X-4 | 14.0 | 70 | 7 | C.I. Solvent Green 5 | 6.0 | 30 |
| 5 | 5 | Compound X-5 | 14.0 | 70 | 7 | C.I. Solvent Green 5 | 6.0 | 30 |
| 6 | 6 | Compound X-6 | 14.0 | 70 | 7 | C.I. Solvent Green 5 | 6.0 | 30 |
| 7 | 1 | Compound X-1 | 18.4 | 92 | 7 | C.I. Solvent Green 5 | 1.6 | 8 |
| 8 | 1 | Compound X-1 | 11.0 | 55 | 7 | C.I. Solvent Green 5 | 9.0 | 45 |
| 9 | 1 | Compound X-1 | 18.0 | 90 | 7 | C.I. Solvent Green 5 | 2.0 | 10 |

TABLE 2-continued

| | Colorant microparticles Dispersion 1 | | | | Colorant microparticles dispersion liquid 2 | | | |
|---|---|---|---|---|---|---|---|---|
| | Colorant microparticles | | Amount | | Colorant microparticles | | Amount | |
| Toner No. | Dispersion No. | Colorant | Parts by weight | Content (%) | dispersion liquid No. | Colorant | Parts by weight | Content (%) |
| 10 | 1 | Compound X-1 | 12.0 | 60 | 7 | C.I. Solvent Green 5 | 8.0 | 40 |
| 12 | 1 | Compound X-1 | 19.8 | 99 | 7 | C.I. Solvent Green 5 | 0.2 | 1 |
| 13 | 1 | Compound X-1 | 9.0 | 45 | 7 | C.I. Solvent Green 5 | 11.0 | 55 |
| 14 | 8 | C.I. Pigment Blue 15:3 | 14.0 | 70 | 7 | C.I. Solvent Green 5 | 6.0 | 30 |
| 15 | 1 | Compound X-1 | 14.0 | 70 | 11 | C.I. Pigment Yellow 74 | 6.0 | 30 |
| 16 | 9 | C.I. Pigment Blue 16 | 10.0 | 50 | 12 | C.I. Pigment Yellow 185 | 10.0 | 50 |
| 17 | 10 | C.I. Solvent Green 7 | 20.0 | 100 | — | — | 0.0 | 0 |
| 18 | 7 | C.I. Solvent Green 5 | 20.0 | 100 | — | — | 0.0 | 0 |
| 19 | 1 | Compound X-1 | 20.0 | 100 | — | — | 0.0 | 0 |

Amount of Colorant microparticles dispersion liquid is based on 100 Parts by weight of binding resin.
Toner 11 was manufactured by a pulverizing method.

Manufacture of Developers

A green developer, a yellow developer and a cyan developer were manufactured by mixing each of the green toner, the yellow toner and the cyan toner obtained above with ferrite earner having volume average particle diameter of 50 μm coated with methyl methacrylate and cyclohexyl methacrylate resin via V type mixing machine so that each toner has toner density of 6% by weight.

EVALUATION

A Developing device unit is equipped with full-color multifunctional machine "bizhub PRO C6500" (manufactured by Konica Minolta Business Technologies, Inc.) and each developer of each toner shown in Table 3, and green images were manufactured. The green developer was installed in magenta developer position. Concerning Comparative sample 7, green developer, yellow developer and cyan developer were installed in a yellow and a cyan developer devices, respectively. The following evaluations were conducted. The result is summarized in Table 3. Chroma of not less than 85, and brightness not less than 60 are acceptable as criteria.

Evaluation of Green Color

A solid green image was formed by green toner solely on POD Gloss-Coat 128 g/m$^2$ paper (produced by Oji Paper Co., Ltd.) having toner attached amount of 4 g/m$^2$, L*, a* and b* were measured, respectively.

Values of chroma C* and brightness C obtained by the following formulae are shown in Table 3.

$$\text{Chroma } (C^*)=[(a^*)^2+(b^*)^2]^{1/2}$$

L*a*b* to determine chroma C* and hue h is specifically measured by a spectrophotometer "GRETAG MACBETH SPECTROLINO" (produced by Gretag Macbeth Co. Ltd.). Similarly to the measurement of reflection spectra, the measurement is carried out with the following conditions: a D65 light source as a light source, a reflection measuring aperture diameter of 4 mm, 10 nm intervals in the wavelength range to be measured, a viewing angle of 2°, and a white tile for adjustment of the base line.

Evaluation of Fixing Performance

Toner images were formed by employing the above described developers installed in modified "bizhub PRO C6500" (manufactured by Konica Minolta Business Technologies, Inc.), so as to have an amount of toner attached of 4 g/m$^2$, and the transferred papers were fixed at a temperature of the fixing heat roller changing in every 20° C. from 100 to 200° C.

Image density was measured for patch portion of the fixed image via Macbeth reflection type densitometer "RD-918".

The measured portion was rubbed with plain weave of bleached cotton 14 times with a load of 22 g/cm$^2$. Image densities before and after rubbing were measured and fixing ratio was calculated by the ratio of densities.

$$\text{Fixing ratio (\%)}=(\text{image density after rubbing})/(\text{image density before rubbing})\times 100$$

Fixing ratio of 80% or more is practically acceptable.

A: 90 to 100%

B: 80 to 90%

C: Not more than 80%

TABLE 3

| | Toner | Evaluation of green color | | Evaluation of fixing performance | | | |
|---|---|---|---|---|---|---|---|
| | No. | Chroma | Brightness | 110° C. | 120° C. | 130° C. | Remarks |
| Example 1 | 1 | 89 | 65 | A | A | A | Green toner image of Invention |
| Example 2 | 2 | 84 | 61 | A | A | A | Green toner image of Invention |
| Example 3 | 3 | 84 | 61 | A | A | A | Green toner image of Invention |
| Example 4 | 4 | 87 | 62 | A | A | A | Green toner image of Invention |
| Example 5 | 5 | 87 | 63 | A | A | A | Green toner image of Invention |
| Example 6 | 6 | 88 | 64 | A | A | A | Green toner image of Invention |

TABLE 3-continued

| | Toner | Evaluation of green color | | Evaluation of fixing performance | | | |
|---|---|---|---|---|---|---|---|
| | No. | Chroma | Brightness | 110° C. | 120° C. | 130° C. | Remarks |
| Example 7 | 7 | 84 | 62 | A | A | A | Green toner image of Invention |
| Example 8 | 8 | 84 | 62 | A | A | A | Green toner image of Invention |
| Example 9 | 9 | 88 | 64 | A | A | A | Green toner image of Invention |
| Example 10 | 10 | 88 | 64 | A | A | A | Green toner image of Invention |
| Example 11 | 11 | 88 | 63 | A | A | A | Green toner image of Invention |
| Comparative Example 1 | 12 | 75 | 55 | B | A | A | Green toner image for Comparison |
| Comparative Example 2 | 13 | 74 | 61 | A | A | B | Green toner image for Comparison |
| Comparative Example 3 | 14 | 80 | 58 | A | A | A | Green toner image for Comparison |
| Comparative Example 4 | 15 | 80 | 58 | B | A | A | Green toner image for Comparison |
| Comparative Example 5 | 16 | 65 | 55 | B | B | A | Green toner image for Comparison |
| Comparative Example 6 | 17 | 61 | 54 | A | B | B | Green toner image for Comparison |
| Comparative Example 7 | 18/19 | 78 | 62 | B | A | A | Green image of secondary color by yellow toner 18 and cyan toner 19 |

Color of Comparative Example 7 was measured by secondary color image formed by using cyan toner and yellow toner so as to have toner attaching amount of 2.8 g/m$^2$ and 1.2 g/m$^2$, respectively.

The green toner of the present invention 1 through 11 have high chroma and high brightness, and have good low temperature fixing performance as demonstrated by the above described result.

The invention claimed is:

1. A green toner for developing a static latent image comprising a binder resin and a colorant, wherein the colorant contains C.I. Solvent Green 5 and colorant compound X represented by Formula (1), and a content ratio of C.I. Solvent Green 5 is 5 to 50% by weight based on total weight of the colorant, Formula (1)

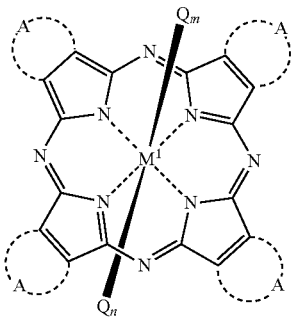

in Formula (1), $M^1$ is Si, Ge or Sn, Q is independently a monovalent substituent, m and n are each 0 or 1, at least one of in and n is 1, and A is independently an atomic group forming an aromatic ring which may have a substituent.

2. The green toner of claim 1, wherein $M^1$ is Si.

3. The green toner of claim 1, wherein each of Q is an alkyl group, an alkoxy group, an aryl group, an aryloxy group, an acyloxy group or a group represented by Formula (2), independently.

Formula (2)

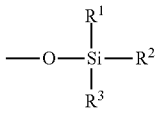

in Formula (2), $R^1$ through $R^3$ represents independently an alkyl group, an aryl group, an alkoxy group or an aryloxy group.

4. The green toner of claim 3, wherein two of Q is an alkoxy group or a group represented by Formula (2), independently.

5. The green over of claim 4, wherein two of Q is independently —O($CH_2$)$_3$$CH_3$, —O(t-$C_4H_9$), —O($CH_2$)$_5$$CH_3$, —O($CH_2$)$_7$$CH_3$, —O(t-$C_8H_{17}$), —O$C_6H_6$, —OCO—$CH_2CH_2CH_3$, —OSi($CH_3$)$_3$, —OSi($CH_2CH_3$)$_3$ or —OSi($CH_2CH_2CH_3$)$_3$.

6. The green toner of claim 4, wherein the Compound X is represented by formula X-1 through formula X-6.

X-1

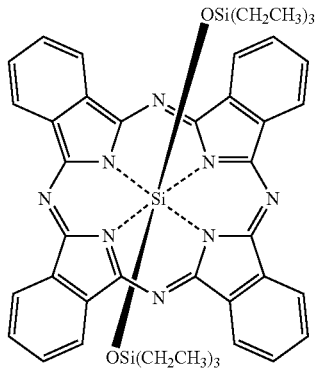

-continued
X-2
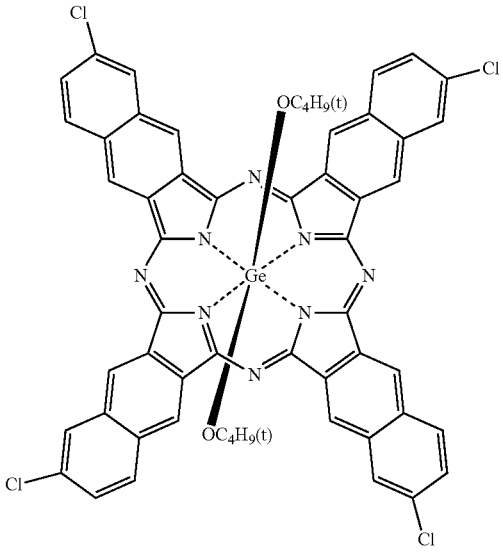
X-3
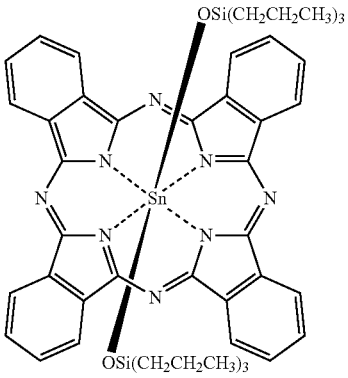
X-4
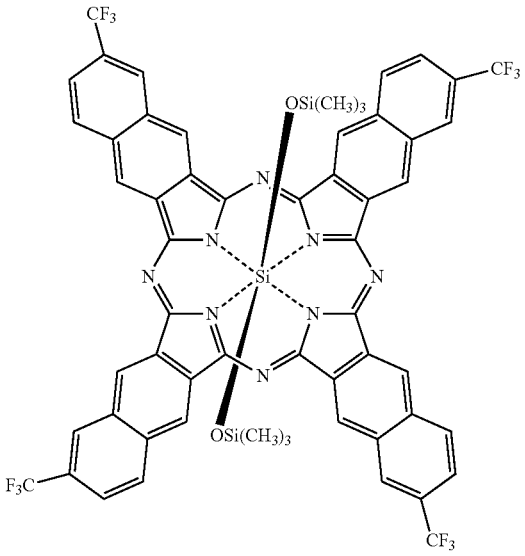
-continued
X-5
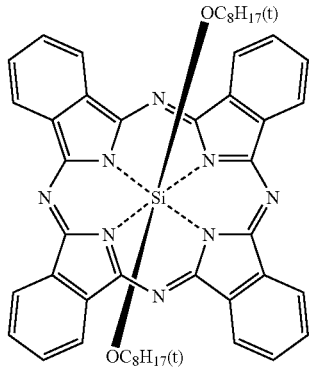
X-6
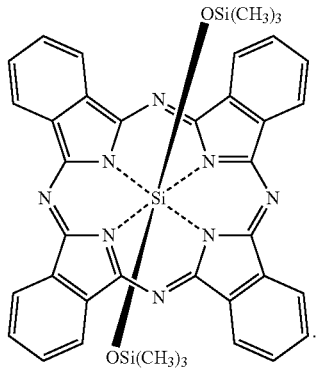
7. The green toner of claim 1, wherein the content ratio of C.I. Solvent Green 5 is 10 to 40% by weight based on total weight of colorant.
8. The green toner of claim 1, wherein two of Q is a group represented by Formula (2).
9. The green toner of claim 1, wherein four A's are independently an atomic group represented by formula (A-1) through (A-7).
(A-1)
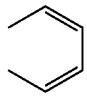
(A-2)
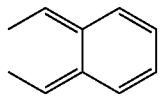
(A-3)
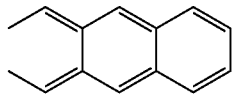
(A-4)
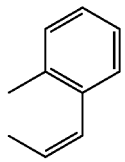

-continued
(A-5)
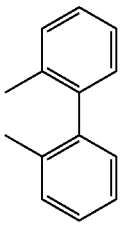
(A-6)
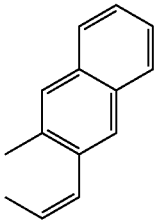
(A-7)
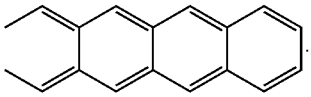
10. The green toner of claim 1, wherein four A's are independently an atomic group represented by formula (a-1) through (a-7).
(a-1)
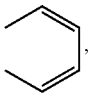
-continued
(a-2)
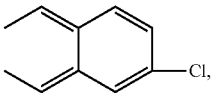
(a-3)
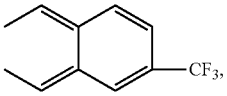
(a-4)
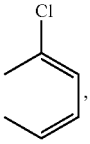
(a-5)
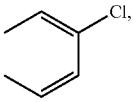
(a-6)
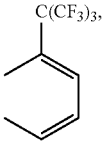
(a-7)
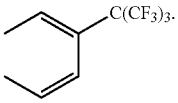
11. A full color image forming method employing the green toner of claim 1 in combination with a yellow toner, a magenta toner, a cyan toner and a black toner.
* * * * *